US010323488B2

(12) United States Patent
Richards

(10) Patent No.: US 10,323,488 B2
(45) Date of Patent: Jun. 18, 2019

(54) GRAVEL PACK SERVICE TOOL WITH ENHANCED PRESSURE MAINTENANCE

(71) Applicant: Halliburton Energy Services, Inc., Houston, TX (US)

(72) Inventor: William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 122 days.

(21) Appl. No.: 15/531,574

(22) PCT Filed: Dec. 31, 2014

(86) PCT No.: PCT/US2014/072992
§ 371 (c)(1),
(2) Date: May 30, 2017

(87) PCT Pub. No.: WO2016/108886
PCT Pub. Date: Jul. 7, 2016

(65) Prior Publication Data

US 2017/0342810 A1 Nov. 30, 2017

(51) Int. Cl.
*E21B 43/04* (2006.01)
*E21B 34/12* (2006.01)
(Continued)

(52) U.S. Cl.
CPC ..... *E21B 43/045* (2013.01); *E21B 33/1275* (2013.01); *E21B 34/12* (2013.01); *E21B 43/08* (2013.01); *E21B 2034/007* (2013.01)

(58) Field of Classification Search
CPC .... E21B 43/045; E21B 33/1275; E21B 34/12; E21B 43/08
See application file for complete search history.

(56) References Cited

U.S. PATENT DOCUMENTS 3,884,301 A * 5/1975 Turner ..... E21B 43/04 166/278
4,733,723 A 3/1988 Callegari, Sr.
(Continued)

OTHER PUBLICATIONS

International Preliminary Report on Patentability issued in related Application No. PCT/US2014/072992, dated Jul. 13, 2017 (12 pages).

(Continued)

*Primary Examiner* — Yong-Suk Ro
(74) *Attorney, Agent, or Firm* — Scott Richardson; Baker Botts L.L.P.

(57) ABSTRACT

A gravel pack system includes a service tool used to maintain a pressure of the wellbore below a hydraulic packer at the same pressure of workstring tubing above the hydraulic packer, prior to and during setting the hydraulic packer. The service tool includes a washpipe disposed at a lower portion of the service tool, a crossover port in a wall of the service tool that enables fluid to flow between workstring tubing and a space between the service tool and a completion string. The service tool also includes a valve disposed in the wall of the service tool that directs fluid from the space between the service tool and the completion string into the service tool and toward the washpipe when the valve is open, the valve being closeable in response to compression of the service tool.

20 Claims, 8 Drawing Sheets

(51) Int. Cl.

| | |
|---|---|
| ***E21B 33/127*** | (2006.01) |
| ***E21B 43/08*** | (2006.01) |
| *E21B 34/00* | (2006.01) |

(56) References Cited

U.S. PATENT DOCUMENTS 4,858,691 A * 8/1989 Ilfrey ..... E21B 43/045 166/278
5,597,040 A * 1/1997 Stout ..... E21B 43/045 166/51
5,826,652 A 10/1998 Tapp
5,975,205 A * 11/1999 Carisella ..... E21B 43/045 166/134
6,237,687 B1 * 5/2001 Barbee, Jr. ..... E21B 43/045 166/134
6,341,654 B1 1/2002 Wilson et al.
7,373,979 B2 * 5/2008 Coronado ..... E21B 43/10 166/278
7,520,326 B1 * 4/2009 Hill ..... E21B 43/045 166/144
2004/0112597 A1 6/2004 Hamid et al.
2005/0028972 A1 2/2005 Wilson et al.
2005/0103495 A1 * 5/2005 Corbett ..... E21B 34/14 166/278
2013/0056200 A1 3/2013 Martinez et al.
2013/0092372 A1 4/2013 Clapp et al.
2013/0118726 A1 * 5/2013 Broussard ..... E21B 43/045 166/51
2013/0333887 A1 12/2013 Geoffroy
2014/0034336 A1 2/2014 Jasek
2015/0218916 A1 * 8/2015 Richards ..... E21B 34/14 166/278
2016/0145958 A1 5/2016 Richards et al.

OTHER PUBLICATIONS

International Search Report and Written Opinion issued in related PCT Application No. PCT/US2014/072992 dated Sep. 7, 2015, 9 pages.
Search Report issued in related Spanish Application No. P201790027, dated Apr. 25, 2018 (9 pages with Translation).

* cited by examiner

GRAVEL PACK SERVICE TOOL WITH ENHANCED PRESSURE MAINTENANCE

CROSS-REFERENCE TO RELATED APPLICATION

The present application is a U.S. National Stage Application of International Application No. PCT/US2014/072992 filed Dec. 31, 2014, which is incorporated herein by reference in its entirety for all purposes.

TECHNICAL FIELD

The present disclosure relates generally to well completion operations and, more particularly, to a gravel pack service tool with a compression closed valve for enhanced pressure maintenance.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, or remedial activities. It is common practice in completing oil and gas wells to set a string of pipe, known as casing, in the well to isolate the various formations penetrated by the well from the wellbore. The casing is typically perforated opposite the formation to provide flowpaths for the valuable fluids from the formation to the wellbore. If production tubing is simply lowered into the wellbore and fluids are allowed to flow directly from the formation, into the wellbore, and through the production tubing to the earth's surface, fine sand from the formation could be swept along with the fluids and carried to the surface by the fluids.

Gravel pack operations are typically performed in subterranean wells to prevent fine particles of sand or other debris from being produced along with valuable fluids extracted from the formation. If produced (i.e., brought to the earth's surface), the fine sand tends to erode production equipment, clog filters, and present disposal problems. Conventional gravel pack operations prevent the fine sand from being swept into the production tubing by installing a sand screen on the end of the production tubing. The wellbore in an annular area between the screen and the casing is then filled with a relatively large grain sand or ceramic proppant (i.e., "gravel"). The gravel prevents the fine sand from packing off around the production tubing and screen, and the screen prevents the large grain sand from entering the production tubing.

Gravel pack systems generally include a packer that is set to seal and anchor the gravel pack system, and the production tubing, in place within the perforated wellbore. Currently, workstring tubing is plugged below the packer and pressure applied to the tubing to set the packer. The tubing is raised afterward to position the tubing for gravel pack pumping operations. Unfortunately, this raising of the gravel pack system while the tubing is plugged can lead to a pressure differential between components above and below the packer. This pressure differential can pull parts of the formation inward toward the wellbore, leading to bridging off or collapse of the formation around the screen of the gravel pack system.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a gravel pack system that features a closeable valve to provide pressure maintenance to a subterranean formation prior to and while setting a packer of the gravel pack system within a wellbore. More specifically, the gravel pack system may include a service tool that provides pressure maintenance to the formation by maintaining fluid communication between the workstring tubing that the gravel pack system is coupled to and the annulus of the wellbore below the packer prior to and during setting of the packer. Thus, the pressure maintenance may be provided via fluid flowing through the workstring tubing. The service tool could also be configured for other tasks, such as providing wash down applications. The pressure maintenance through the formation available using the disclosed service tool may prevent the gravel pack system from swabbing the formation after setting the packer. That is, the service tool may maintain the pressure in the formation below the packer at the same pressure as the fluid in the workstring tubing so that raising the service tool does not create a vacuum in the lower portion of the wellbore. Creation of this vacuum or suction force in the wellbore below the packer, also known as "swabbing the formation", could lead to collapse of a perforated portion of the formation.

Figure 1:
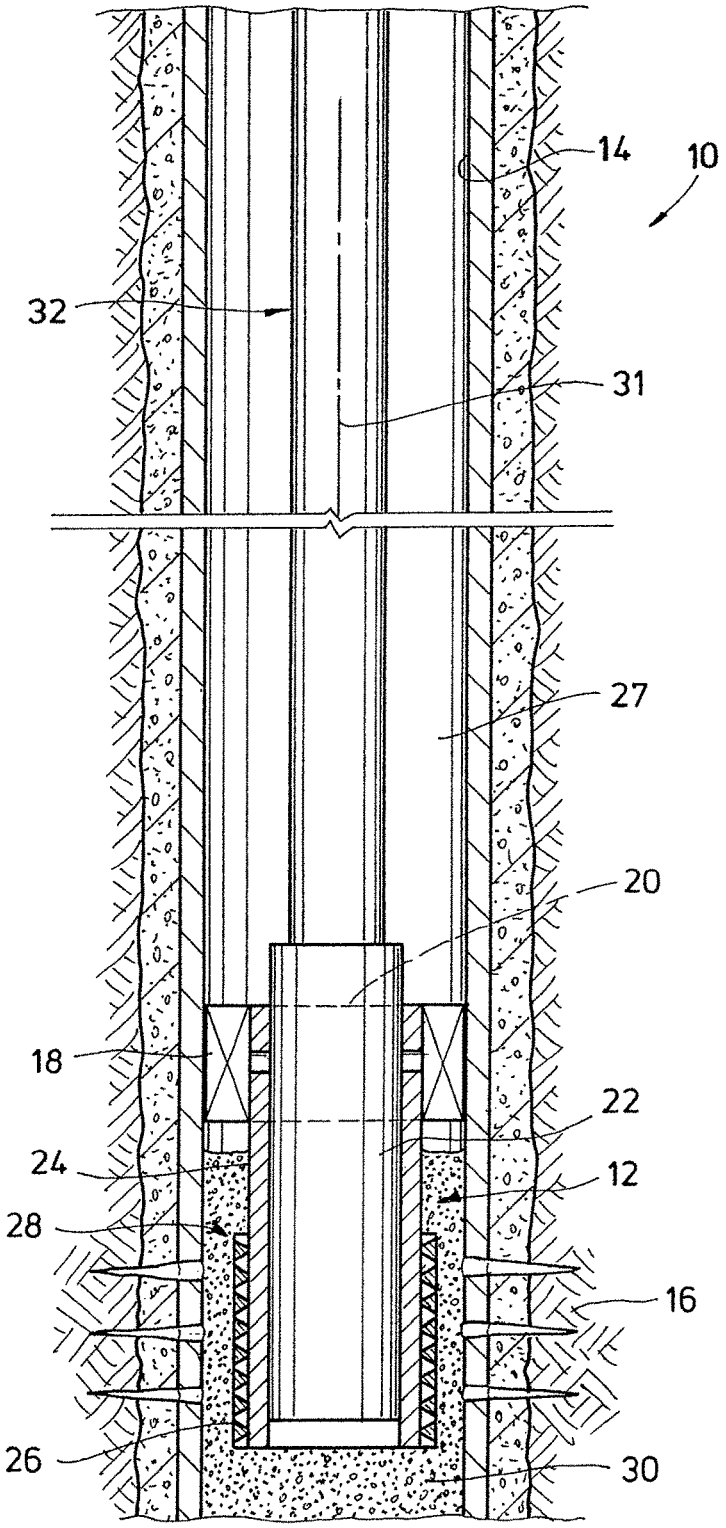
FIG. 1 is a schematic partial cross-sectional view of a gravel pack system in a wellbore environment, in accordance with an embodiment of the present disclosure.

Referring now to FIG. 1, an example of a wellbore operating environment 10 is shown. As depicted, the operating environment 10 includes a gravel pack system 12 that has been positioned in the wellbore 14 which intersects a subterranean formation or zone 16. All or part of the gravel pack system 12 may be positioned in a cased or uncased portion of the wellbore 14. In the illustrated embodiment, the system 12 includes a gravel pack packer 18, a setting tool 20, a service tool 22, an outer completion string such as a gravel pack circulating sleeve 24, and one or more screens 26.

The gravel pack packer 18 is set in the wellbore 14 to isolate a zone of the wellbore 14 beneath the packer 18 for gravel packing. After the packer 18 is set in the wellbore 14, an annulus 28 between the well screens 26 and the wellbore 14 may be packed with gravel 30, as described in detail below. The setting tool 20 may be part of or coupled to the service tool 22, and the setting tool 20 is designed to set the packer 18. The packer 18 may be a mechanically or hydraulically set packer. In such instances, the setting tool 20 may set the packer 18 by directing pressurized hydraulic fluid to apply a compressive force to the packer 18, thereby sealing the gravel pack portion of the wellbore 14. After setting the packer 18, the setting tool 20 may release from the packer 18, enabling the service tool 22 and setting tool 20 to be moved axially (in a direction along the axis 31) through the gravel pack system 12 to open and close the circulating sleeve 24.

As illustrated, the gravel pack system 12 may be attached to a tubular string 32 (e.g., workstring tubing string) that is conveyed into the wellbore 14. The system 12 may be lowered into the wellbore 14 via the tubular string 32. The tubular string 32 may be moved up and down at different points while positioning the system 12 in the wellbore 14 and after the setting tool 20 sets the packer 18 for gravel pack operations.

Existing gravel pack systems typically close off the portion of the tubular string above the packer from the portion of the service tool and wellbore below the packer while setting the packer. For example, some existing gravel pack systems utilize a dropped ball to block the flow of fluid from the tubular string through the gravel pack system, in order to divert high pressure fluid to set the packer. However, such techniques do not allow for pressure maintenance through the wellbore. That is, these techniques may allow the tubular string above the packer to reach pressures much higher than the pressure of the wellbore below the packer. At this point, if the tubular string is raised, the pressure differential could lead to undesirable swabbing of the formation. To prevent swabbing the formation 16 prior to and while setting the packer 18, the disclosed system 12 includes a service tool 22 that enables pressure maintenance throughout the wellbore 14 prior to and during the packer setting process. As discussed in detail below, the service tool 22 may include an inner tube (e.g., circulating port) that defines a valve conduit for directing a flow of fluid from the tubular string 32 to a washpipe 34 (lower portion of the service tool 22) and into the wellbore 14 below the packer 18. Thus, the system 12 may be capable of setting the packer 18 without blocking the flow of fluid from the workstring tubing through the service tool 22. After setting the packer 18, the system 12 may close a valve in the service tool 22, thereby closing off the flow of fluid through the service tool 22 so that gravel pack operations can be performed.

It should be noted that, although FIG. 1 depicts a vertical well, the principles of the present disclosure may be equally well-suited for use in deviated wells, inclined wells, horizontal wells, or multi-lateral wellbore completions. Also, the wellbore operating environment 10 depicted in FIG. 1 may be provided through the use of an offshore platform, a land-based drilling and production rig, service rigs, or other oil and gas rigs located at any desired geographical location.

Figure 2:
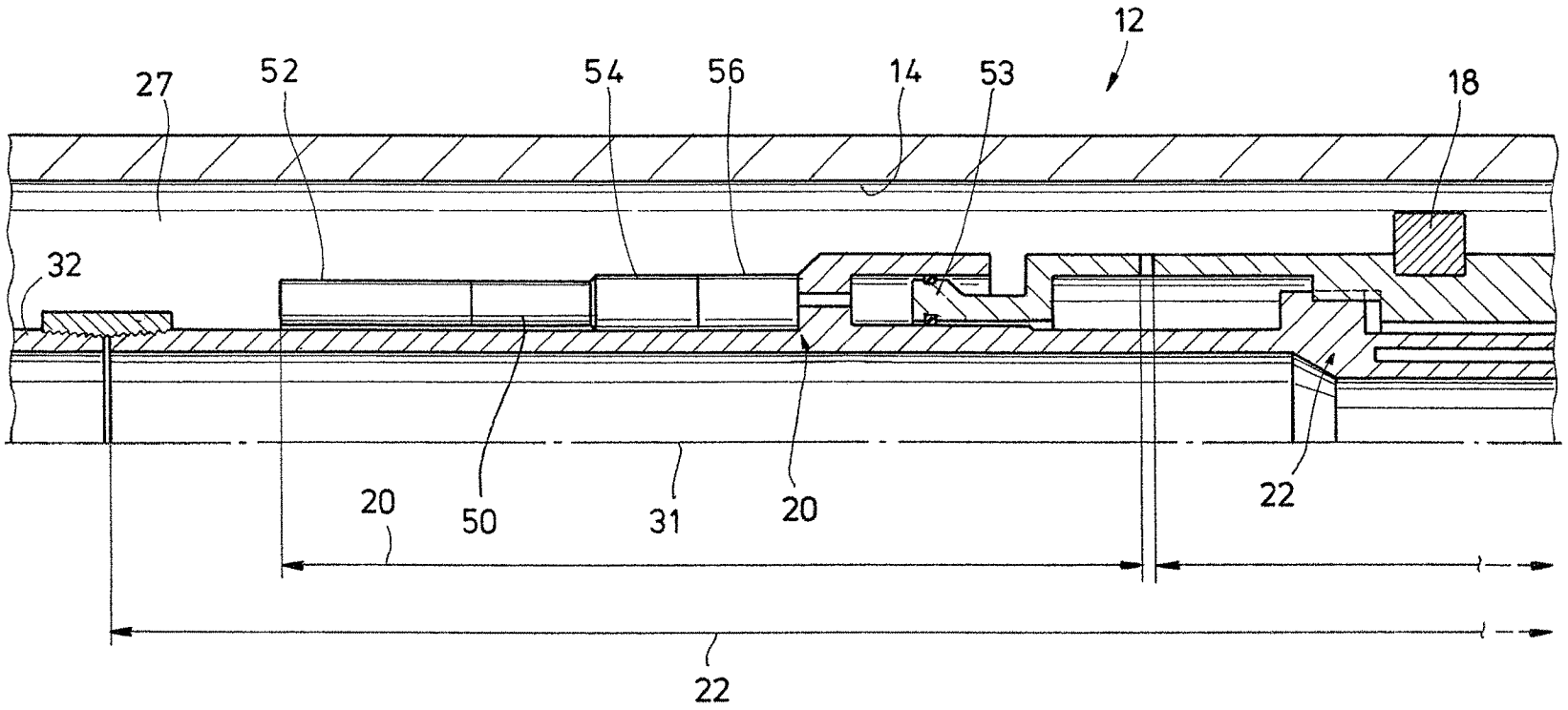
FIG. 2 is a schematic view of certain components of the gravel pack system of FIG. 1, in accordance with an embodiment of the present disclosure.

Having now discussed the general operational context in which the service tool 22 may be used, a more detailed description of various embodiments of the service tool 22 will be provided. FIG. 2 schematically represents the components of the service tool 22 and the setting tool 20 that may be used to set the packer 18 while providing pressure maintenance in the wellbore 14. It should be noted that other types of setting tools 20 may be used in other embodiments of the disclosed gravel pack system 12. In the illustrated embodiment, the service tool 22 may utilize a battery powered setting tool 20 to set the gravel pack packer 18. For example, the illustrated service tool 22 may include an electric pump 50 connected to the hydraulic setting tool 20. The electric pump 50 may utilize filtered well fluids or utilize a reservoir of hydraulic fluid (or some other fluid) 52 directed toward a hydraulic piston 53 to provide the compression force to set the hydraulic packer. The electric pump 50 may be powered by a battery pack 54, and controlled in response to a sensor 56 that measures, for example, hydraulic fluid pressure going to the piston 53, temperature, or stresses and strains on components of the service tool 22.

The illustrated service tool 22 may utilize the battery powered setting tool 20 to set the packer 18, so that the gravel pack system 12 does not have to utilize a dropped ball to pressurize the setting tool 20. By not using a dropped ball, the system 12 may not plug a flow of fluid through the internal flow tube of the service tool 22. This may enable the service tool 22 to maintain the pressure through the wellbore 14 without having to use a more complicated flow diverting setup. In addition, the absence of a dropped ball may simplify the service tool 22, since no ball seat and corresponding sleeves are needed to actuate the setting tool 20. Further, the method of setting the disclosed service tool may reduce the number of balls that do not seal properly in the tubular string or gravel pack system 12, thereby increasing the reliability of the system operation. Still further, the service tool 22 that does not utilize a dropped ball to actuate the setting tool 20 may also eliminate the rig time normally spent waiting for a dropped ball to land in the service tool 22. Again, it should be noted that other types of service tools 22 and overall gravel pack systems 12 may be used in other embodiments to facilitate pressure maintenance along the wellbore 14 prior to and during setting the packer 18, regardless of how the service tool 22 actuates the setting tool 20.

Figure 3:
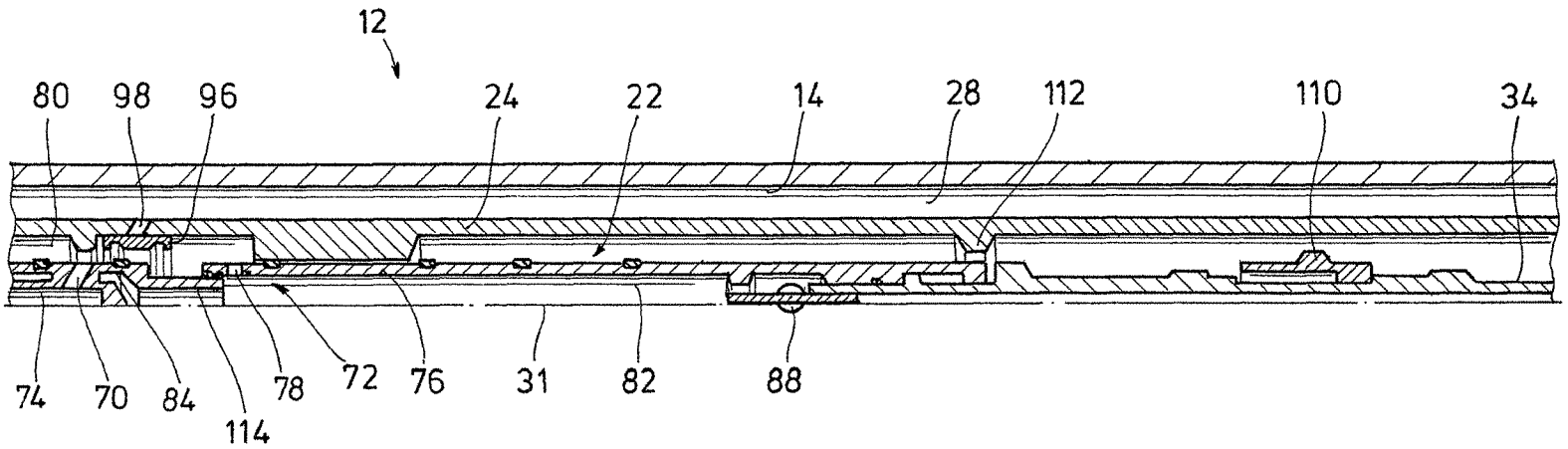
FIG. 3 is a schematic cross-sectional view of the gravel pack system of FIG. 1 with an open pressure maintenance valve, in accordance with an embodiment of the present disclosure.
Figure 4:
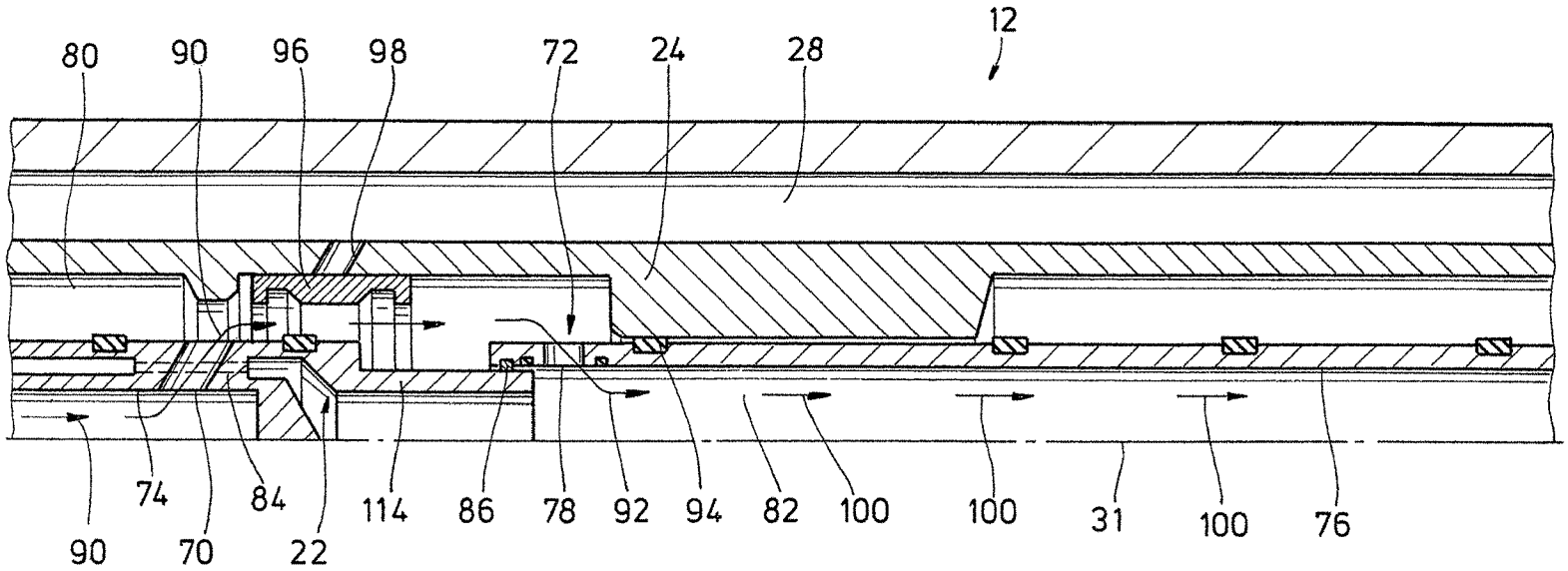
FIG. 4 is a close up schematic view of the gravel pack system of FIG. 3, in accordance with an embodiment of the present disclosure.

FIGS. 3-6 illustrate an embodiment of certain components of the gravel pack system 12 that may be used to provide pressure maintenance through the wellbore 14. Specifically, the illustrated embodiments show the service tool 22, which is at least partially disposed in the circulating sleeve 24. FIGS. 3 and 4 illustrate the service tool 22 in operation when the gravel pack system 12 is being lowered into the wellbore 14 via workstring tubing 32 and while setting the packer 18 (as shown in FIG. 1). At this time, the system 12 is providing pressure maintenance to the wellbore 14 by allowing fluid to flow from the workstring tubing 32 coupled to the upper portion of the service tool 22, through the service tool 22, down into the washpipe 34 (described above with reference to FIG. 1), and through the screens 26 into the wellbore 14 at a position below the packer 18. As discussed above, this may maintain approximately the same pressure both above and below the packer 18 prior to and during setting of the packer 18. That way, if the service tool 22 is raised after setting the packer, it does not create a suction force through the lower part of the wellbore 14.

As illustrated in FIGS. 3 and 4, the service tool 22 of the gravel pack system 12 includes a crossover port 70 and a valve 72 used to direct fluid flowing through the service tool 22. In the illustrated embodiment, the valve 72 is disposed below the crossover port 70 (when the service tool 22 is oriented vertically within the wellbore 14), and the valve 72 may be open as the gravel pack system 12 is run into the wellbore 14 and while setting the packer. The valve 72, when open, facilitates a flow of fluid from the workstring tubing 32, through the service tool 22 and toward the washpipe described above. When the valve 72 is closed, the service tool 22 routes the fluid flowing from the workstring tubing coupled to an upper portion of the service tool 22 into the annulus 28 between the circulating sleeve 24 and the wellbore 14.

In the illustrated embodiment, the service tool 22 includes two internal sleeves 74 and 76 disposed within the circulating sleeve 24. The first sleeve 74 may be referred to as a mandrel sleeve 74 in some embodiments. The second sleeve 76 may be referred to as a housing sleeve 76. The terms "mandrel sleeve" 74 and "housing sleeve" 76 refer to the placement of the sleeves relative to each other, since the mandrel sleeve 74 may be at least partially received into the housing sleeve 76. The opening and closing action of the valve 72 may be actuated via the sliding of these sleeves 74 and 76 relative to each other, as described in detail below. As illustrated, the crossover port 70 may be formed in the mandrel sleeve 74 while the valve 72 may be formed in the housing sleeve 76. However, it should be noted that in other embodiments the crossover port 70 and the valve 72 may be oppositely arranged in the sleeves 74 and 76. In further embodiments, the crossover port 70 and the valve 72 may both be formed in the same sleeve (e.g., 74 or 76). In still further embodiments, the valve 72 may include ports formed through both sleeves 74 and 76.

As noted above, the illustrated valve 72 is in an open position. Specifically, the valve 72 may include a housing port 78 formed through the housing sleeve 76 that allows fluid to flow from a space 80 (between the circulating sleeve 24 and the housing sleeve 76) and an internal portion or flow path 82 through the service tool 22 (below the crossover port 70). While the valve 72 is open, a return port 84 of the service tool 22 may be sealed off at the packer bore so that fluid flowing into the flow path 82 is routed downward through the service tool washpipe and into the wellbore 14.

When the valve 72 is in this open position, the system 12 may be used for pressure maintenance or as a washdown system. The service tool 22 may form a continuous flowline between the workstring tubing 32 coupled thereto and the washpipe at the lower portion of the service tool 22. Treatment fluids may be pumped down the workstring tubing, through the open valve 72 of the service tool 22, and into the fractured zone of the wellbore 14. Thus, the service tool 22 may facilitate both pressure maintenance through the wellbore 14 and any desired washdown treatments while the valve 72 is open.

To keep the valve 72 open during run in and packer setting operations, the valve 72 may be pinned into the open position. For example, as illustrated in FIG. 4, one or more shear pins 86 may be coupled between the mandrel sleeve 74 and the housing sleeve 76 to maintain the valve 72 in the open position. In other embodiments, the service tool 22 may include a spring or other biasing component used to maintain the valve 72 in the open position.

As noted above, the valve 72 may be open as the setting tool 20 sets the packer 18 (as described with reference to FIG. 1). This allows the inner diameter of the workstring tubing 32 to remain open to the formation while setting the packer.

The packer may be set, as described above, and pressure tested using fluid pumped down an annulus 27 (above the packer), shown in FIG. 1. All the while, the fluid from the workstring tubing 32 may flow through the valve 72 of the service tool 22 and into the formation below the packer. Thus, when the service tool 22 is raised after setting the packer to the first pump position, the formation is not swabbed due to a pressure differential between the workstring tubing 32 above the packer and the wellbore 14 below the packer.

Unlike existing gravel pack systems, the disclosed system 12 utilizes fluid from the workstring tubing 32, not annulus fluid, to facilitate pressure maintenance down the wellbore 14. Thus, the pressure can be maintained even while the packer is being set to form a pressure seal that isolates one portion of the annulus from another. In addition, by providing the pressure maintenance through the workstring tubing 32 instead of the annulus 27, the service tool 22 may be shortened compared to tools that utilize the annulus fluid above the packer to provide pressure maintenance.

In some embodiments, the use of fluid flowing from the workstring tubing 32 may enable the service tool 22 to perform operations other than just pressure maintenance. For example, acid treatment fluid may be pumped from the workstring tubing 32 through the open valve 72, the washpipe, and the screens to further stimulate the formation. To provide this stimulation position, the service tool 22 may have the valve 72 open and the return port 84 sealed to direct the high pressure acid treatment fluid into the perforated formation.

The service tool 22 may include certain features that aid in switching the valve 72 from an open position to a closed position after the packer is set. In the illustrated embodiment, the service tool 22 may include the valve 72, a multi-acting ball check 88, and a weight down collet 110. The valve 72 may be used with a single acting collet or with a multi-acting collet. In some embodiments, the valve 72 may be used with a multi-acting ball check, a reverse acting ball check (RABC) valve, or a multi-acting reverse valve (MARV). The multi-acting ball check 88 may be pinned open in the run-in position, as illustrated. This allows fluid flowing through the valve 72 to continue down the flow path 82 toward the washpipe at the bottom of the service tool 22.

FIG. 4 illustrates the flow of fluid through the service tool 22 when the valve 72 is open. First, fluid may flow from the workstring tubing 32 out through the crossover port 70 (e.g., arrows 90) into the space 80 between the service tool 22 and the circulating sleeve 24. From here, the fluid may only flow into the valve 72 (e.g., arrow 92) since all other exits from the space 80 are sealed. For example, the system 12 may include a seal 94 formed between the service tool 22 and a projection of the circulating sleeve 24, as well as a blocking component 96 positioned over a circulating port 98 (i.e., the inner tube) in the circulating sleeve 24. The fluid may flow through the open valve 72 into the flow path 82 inside the service tool 22, through the multi-acting ball check 88, and down toward the washpipe, as illustrated by arrows 100. Thus, the open valve 72 maintains an open flowline between the workstring tubing 32 coupled to the gravel pack system 12 above the packer and the washpipe portion of the service tool 22 below the packer prior to and while setting the packer.

Figure 5:
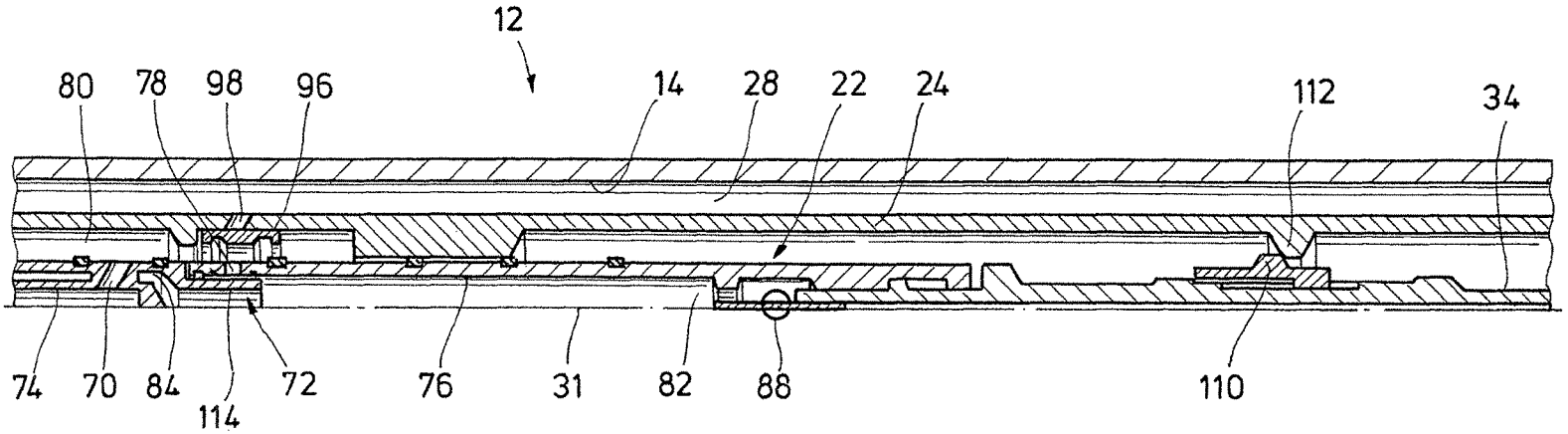
FIG. 5 is a schematic cross-sectional view of the gravel pack system of FIG. 1 with a closed pressure maintenance valve, in accordance with an embodiment of the present disclosure.
Figure 6:
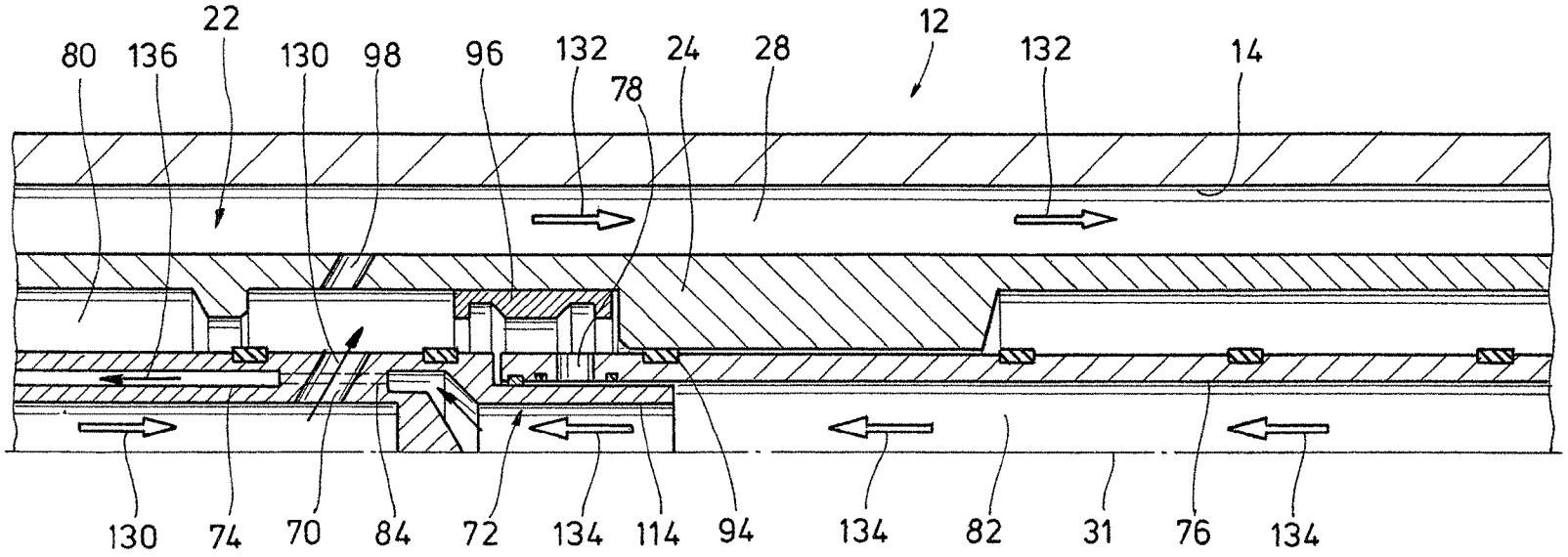
FIG. 6 is a close up schematic view of the gravel pack system of FIG. 5, in accordance with an embodiment of the present disclosure.

After the packer is set, it may be desirable to close the valve 72 in order to route gravel through the service tool 22 into the annulus 28 for gravel packing. When it is time to perform the gravel pack operation, an operator may close the valve 72. In some embodiments, the mechanism for closing the valve 72 includes the weight down collet 110. The valve 72 may be closed when weight applied from the surface (e.g., via the workstring tubing 32) forces the mandrel sleeve 74 into the weight down position, as shown in FIGS. 5 and 6.

In some embodiments, the closing operation may rely on an operator controlling the workstring tubing by first picking up and then setting down weight on the mandrel sleeve 74. As illustrated in FIGS. 3 and 5, the service tool 22 may include the weight down collet 110 on the housing sleeve 76, while the circulating sleeve 24 may include a corresponding indicator collar portion 112 designed to engage with the weight down collet 110 under certain conditions. To close the valve 72, an operator may control the workstring tubing to lift the service tool 22 relative to the stationary circulating sleeve 24 until the indexing feature 110 on the housing sleeve 76 locates in the indicator collar portion 112, as illustrated in FIG. 5. From this position, the operator may control the workstring tubing to lower (e.g. put weight down on) the service tool 22. The indicator collar portion 112 may keep the housing sleeve 76 from moving downward in response to the applied weight, and the compression of the mandrel sleeve 74 relative to the housing sleeve 76 may shear the shear pins 86 or snap out a collet to close the valve 72. In the illustrated embodiment of FIGS. 3-6, the mandrel sleeve 74 may include an extension 114 designed to cover and substantially block the port 78 through the housing sleeve 76, thereby closing and sealing the valve 72.

The above described method for closing the valve 72 may be performed with relatively low, or no, wait time compared to systems that utilize dropped balls to close a valve. In addition, the service tool 22 may utilize a robust design built from components with a high reliability, so that the valve 72 can be easily controlled by an operator at the surface. It should be noted that other configurations of the service tool 22 may feature a valve 72 that can be closed using a similar method of putting weight down on a collet feature of the service tool 22.

Certain embodiments of the service tool 22 may include a locking mechanism to maintain the valve 72 in the closed position after it is closed. For example, as described in detail below, the service tool 22 may include a lock ring or snap ring that locks the valve 72 closed by locking the mandrel sleeve 74 and the housing sleeve 76 in a fixed position relative to each other. In other embodiments, the service tool 22 may be designed to allow the valve 72 to be selectively closed and opened again multiple times without locking in the closed position. This option may be particularly useful if the service tool 22 is being used to perform the gravel pack operation and to perform fracturing or other jobs while downhole.

After the valve 72 is closed, the service tool 22 may be used to perform the gravel pack operation, as illustrated in FIG. 6. First, fluid may flow from the workstring tubing 32 out through the crossover port 70 (e.g., arrows 130) into the space 80 between the service tool 22 and the circulating sleeve 24. From here, the fluid may only flow into the circulating port 98 since all other exits from the space 80 are sealed. The valve 72 is closed via the extension 114 disposed over the port 78. In addition, the system 12 may include the seal 94 formed between the service tool 22 and the circulating sleeve 24, and the blocking component 96 may be pushed away from the circulating port 98 to allow the fluid to exit the circulating sleeve 24 via the port 98.

The fluid may flow through the annulus 28 outside the gravel pack system 12 and toward the screens of the system 12, as shown by arrows 132. Fluid returns from the gravel pack operation may come through the screens of the gravel pack system 12 and up the washpipe into the inside flow path 82 of the service tool 22, as shown by arrows 134. From here, the fluid returns may flow past the closed valve 72 and into the return path 84 (e.g., arrow 136) through the crossover section of the service tool 22. Thus, the closed valve 72 allows fluid to transport proppant or particulates from the workstring tubing 32 to the annulus 28 around the screens in order to establish a gravel pack to control sand production from the formation. Once the gravel pack is performed as described above, the gravel packed into the annulus 28 of the wellbore 14 may prevent any undesirable effects (e.g., swabbing the formation) caused by raising the service tool 22 with the closed valve 72 through the wellbore 14.

Although the valve opening/closing mechanisms, fluid flowpaths, and gravel operations available through the disclosed service tool 22 have been described above in reference to FIGS. 3-6, it should be noted that other specific tool configurations may be used to provide the same effects. For example, FIGS. 7 and 8 provide two different embodiments of components of the service tool 22 that may be utilized to provide the desired pressure maintenance through the wellbore 14 prior to and during the packer setting operation.

Figure 7:
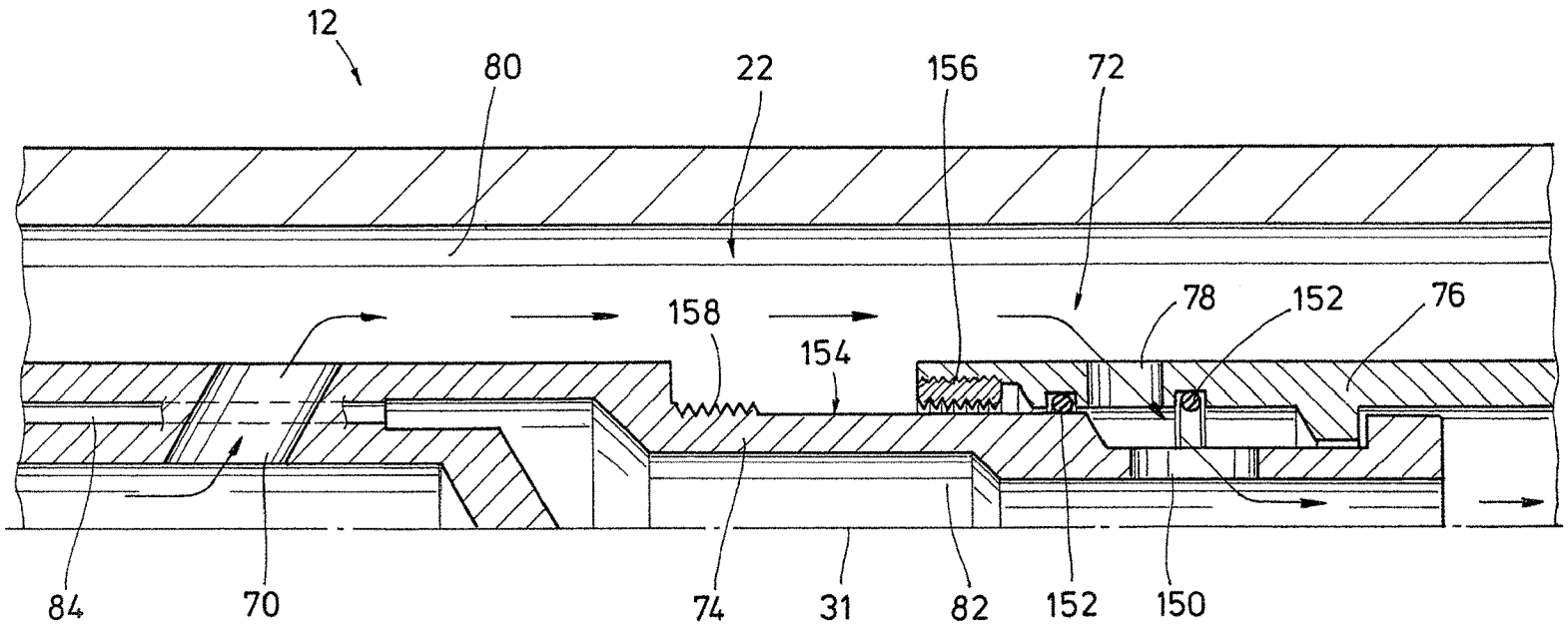
FIG. 7 is a schematic cross-sectional view of components of the gravel pack system of FIG. 1, in accordance with an embodiment of the present disclosure.
Figure 8:
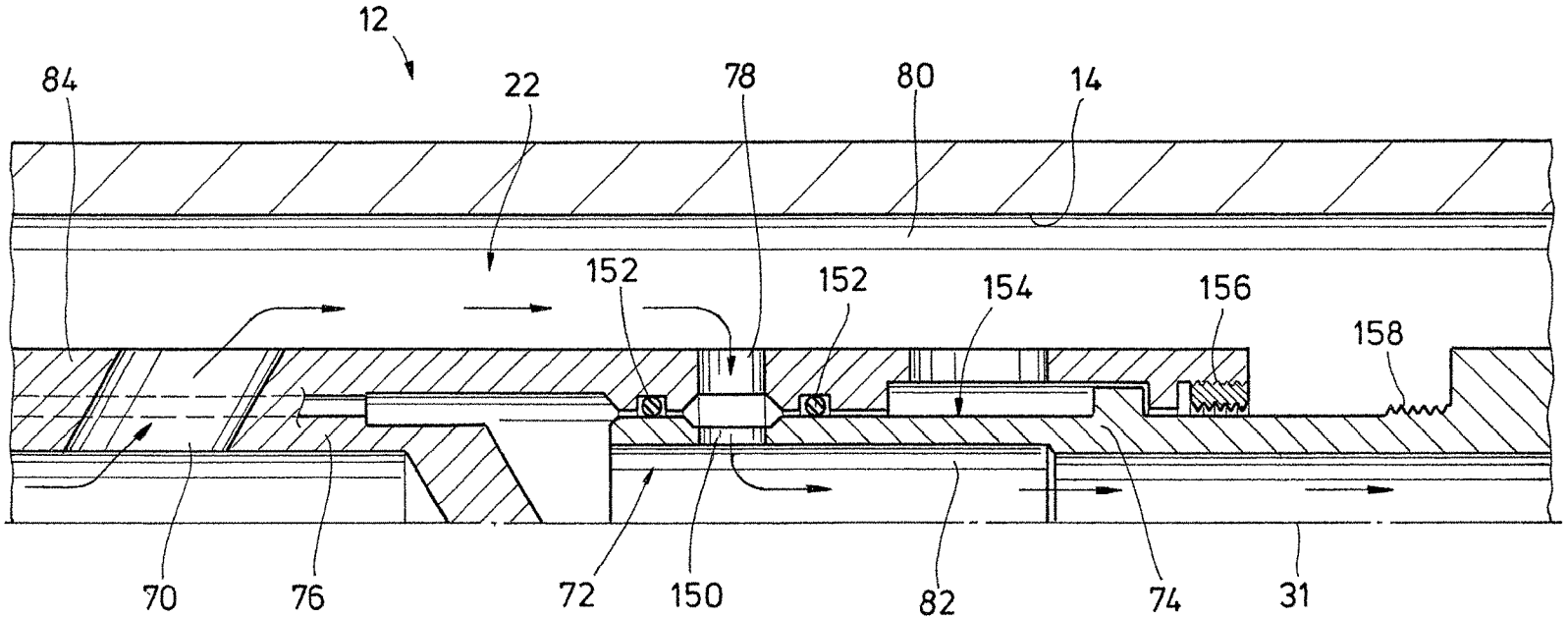
FIG. 8 is a schematic cross-sectional view of components of the gravel pack system of FIG. 1, in accordance with an embodiment of the present disclosure.

For example, FIG. 7 illustrates an embodiment of the service tool 22 that includes the crossover port 70 formed in the mandrel sleeve 74 and the closeable valve 72 formed via overlapping sections of the mandrel sleeve 74 and the housing sleeve 76. As before, the valve 72 may be open in the run-in position to provide a flow path from the workstring tubing to the washpipe of the service tool 22. When the valve 72 is in this open position, as illustrated, a fluid flow may exit the crossover port 70 and enter the service tool 22 again through the housing port 78 and a corresponding mandrel port 150 formed through the mandrel sleeve 74. Thus, the housing port 78 and the mandrel port 150 may together form the valve 72. The valve 72 is open when the housing port 78 and the mandrel port 150 are aligned, and the valve 72 is closed when the housing port 78 and the mandrel port 150 are no longer aligned. The valve 72 may be closed with sit down weight or compression applied to the mandrel sleeve 74 of the service tool 22. Such compression may move seals 152 formed on a surface of the housing sleeve 76 (around the housing port 78) up onto a seal surface 154 of the mandrel sleeve 74. In addition, a lock ring 156 disposed on the housing sleeve 76 may engage a corresponding catch profile 158 formed on the mandrel sleeve 74 to lock the mandrel sleeve 74 and the housing sleeve 76 into the compressed position. This may effectively lock the valve 72 in the closed position, so that fluid is then directed into the annulus to perform the gravel pack operation, as described above.

Other embodiments of the service tool 22 with the locking valve 72 may be utilized as well. For example, as shown in FIG. 8, the crossover port 70 may be disposed in the housing sleeve 76 and the components of the valve 72 may be located closer to the crossover port 70. In this illustrated embodiment, the valve 72 may be open in the run-in position to provide a flow path from the workstring tubing to the washpipe of the service tool 22. Specifically, the open valve 72 may allow a fluid flow to exit the crossover port 70 and enter an inner portion of the service tool 22 through the housing port 78 and the corresponding mandrel port 150. The housing port 78 and the mandrel port 150 may together form the valve 72. The valve 72 is open when the housing port 78 and the mandrel port 150 are aligned, and the valve 72 is closed when the housing port 78 and the mandrel port 150 are no longer aligned.

The valve 72 may be closed with sit down weight or compression applied to the housing sleeve 76 of the service tool 22. Such compression may move the seals 152 of the housing sleeve 76 along the seal surface 154 of the mandrel sleeve 74. In addition, the lock ring 156 disposed on the housing sleeve 76 may engage the corresponding catch profile 158 formed on the mandrel sleeve 74 to lock the mandrel sleeve 74 and the housing sleeve 76 into the compressed position. This may effectively lock the valve 72 in the closed position, so that fluid is then directed into the annulus to perform the gravel pack operation, as described above.

It should be noted that other variations of the components that make up the disclosed service tool 22 may be utilized in other embodiments. For example, the lock ring 156 and corresponding catch profile 158 may be arranged on the mandrel sleeve 74 and the housing sleeve 76, respectively. In addition, the valve 72 may include any desirable combination of ports, extensions, seal surfaces, and so forth that facilitate a closeable flow path from the space 80 to the inner flow path 82 of the service tool 22 via sliding of two or more sleeves relative to each other.

Embodiments disclosed herein include:

A. A completion system including an outer completion string having at least one packer disposed thereon, a service tool arranged within the outer completion string and releasably attached to the packer, and a valve disposed in the service tool, wherein the valve is movable between a first position and a second position. The service tool includes an inner tube that defines a valve conduit. The first position of the valve allows fluid to flow from tubing coupled to the service tool above the packer into an annulus outside the service tool below the packer, and the second position of the valve prevents fluid from the tubing from entering the annulus.

B. A method includes directing a fluid flow from workstring tubing coupled to a completion system into a space between the service tool and an outer completion string disposed around the service tool. The method also includes directing the fluid flow from the space between the service tool and the outer completion string into an internal portion of the service tool and toward a washpipe disposed at a bottom portion of a service tool, when a valve of the service tool is in a first position. The method further includes blocking the fluid flow from entering the internal portion of the service tool when the valve is in a second position.

C. A gravel pack system including a service tool. The service tool includes a washpipe disposed at an end of the service tool. The service tool also includes a crossover port disposed in a wall of the service tool that enables fluid to flow between workstring tubing coupled to an upper portion of the service tool and a space between the service tool and an outer completion string. Further, the service tool includes a valve disposed in the wall of the service tool that directs fluid from the space between the service tool and the outer completion string into the service tool and toward the washpipe when the valve is open.

Each of the embodiments A, B, and C may have one or more of the following additional elements in combination: Element 1: wherein the valve in the first position maintains fluid communication between the tubing and the annulus below the packer prior to and during setting of the packer. Element 2: further including a setting tool comprising a battery, a pump, a controller, and a hydraulic piston for applying a compression force to actuate the packer by pressuring fluid via the pump to produce pressure behind the piston in order to seal and anchor the packer to a wellbore. Element 3: further including a setting tool for setting the packer in a wellbore while maintaining a pressure within the tubing at approximately the same pressure as in the wellbore below the packer. Element 4: wherein the service tool is releasable from the packer to move upward through the outer completion string with the valve in the first position. Element 5: wherein the service tool is movable from the first position to the second position via a compression force.

Element 6: further including locking the valve in the second position. Element 7: wherein locking the valve in the second position includes engaging a lock ring of a first sleeve of the service tool with a catch profile on a second sleeve of the service tool. Element 8: further including maintaining the valve in the first position prior to and while a setting tool coupled to the service tool sets a packer in a wellbore. Element 9: further including setting the packer via a setting tool while maintaining fluid communication between the workstring tubing and the wellbore below the packer. Element 10: further including closing the valve by applying a compression force to the service tool via the workstring tubing. Element 11: further including directing the fluid flow from the washpipe, through one or more screens disposed at a lower portion of the outer completion string, and into an annulus when the valve is in the first position.

Element 12: further including the outer completion string; a packer for isolating a portion of a wellbore formed in a subterranean formation, wherein at least a portion of the outer completion string is disposed at a position below the packer and at least partially surrounding the service tool; one or more screens disposed at a lower end of the outer completion string; and a setting tool disposed within and removably coupled to the packer, wherein the setting tool is coupled to the service tool. Element 13: wherein the outer completion string includes a gravel pack circulating sleeve comprising a circulating port through a wall of the gravel pack circulating sleeve that enables fluid to flow from the space between the service tool and the outer completion string to a position outside the outer completion string. Element 14: wherein the service tool includes a shearable connection that maintains the valve open and shears in response to compression of the service tool. Element 15: wherein the service tool further includes a locking mechanism for locking the valve in a closed position when the valve is closed in response to compression of the service tool. Element 16:

wherein the service tool further includes a first sleeve having the crossover port disposed therein and a second sleeve, wherein the first and second sleeves of the service tool are in a sliding engagement for closing or opening the valve, and wherein one of the first sleeve or the second sleeve includes an extension that closes over the valve when the first sleeve and the second sleeve are compressed relative to each other. Element 17: wherein the service tool further includes a first sleeve having the crossover port disposed therein and a second sleeve, wherein the first and second sleeves of the service tool are in a sliding engagement for closing or opening the valve, and wherein the first sleeve includes a first port formed therein and wherein the second sleeve includes a second port formed therein such that the valve is open when the first and second ports are aligned with each other, and the valve is closed when the first and second ports are no longer aligned.

Although the present disclosure and its advantages have been described in detail, it should be understood that various changes, substitutions and alterations can be made herein without departing from the spirit and scope of the disclosure as defined by the following claims.

What is claimed is:

1. A completion system, comprising:

an outer completion string having at least one packer disposed thereon;

a service tool arranged within the outer completion string and releasably attached to the packer, wherein the service tool comprises an internal flow path extending therethrough, and wherein the outer completion string is disposed around the service tool; and a valve disposed in the service tool, wherein the valve is movable between a first position and a second position, wherein the valve in the first position allows fluid to flow from tubing coupled to the service tool above the packer into an annulus between the service tool and the outer completion string below the packer and from the annulus directly into the internal flow path of the service tool, and wherein the valve in the second position prevents fluid from the tubing from flowing through the annulus directly into the internal flow path of the service tool.

2. The completion system of claim 1, wherein the valve in the first position maintains fluid communication between the tubing and an annulus outside of the outer completion string below the packer prior to and during setting of the packer.

3. The completion system of claim 1, further comprising a setting tool coupled to the service tool, wherein the setting tool comprises a battery, a pump, a controller, and a hydraulic piston for applying a compression force to actuate the packer by pressuring fluid via the pump to produce pressure behind the piston in order to seal and anchor the packer to a wellbore.

4. The completion system of claim 1, further comprising a setting tool for setting the packer in a wellbore while maintaining a pressure within the tubing at approximately a same pressure as in the wellbore below the packer.

5. The completion system of claim 1, wherein the service tool is releasable from the packer to move upward through the outer completion string with the valve in the first position.

6. The completion system of claim 1, wherein the service tool is movable from the first position to the second position via a compression force.

7. A method comprising:

directing a fluid flow from workstring tubing coupled to a completion system into a space between a service tool of the completion system and an outer completion string of the completion system disposed around the service tool;

directing the fluid flow from the space between the service tool and the outer completion string into an internal flow path of the service tool and toward a washpipe disposed at a bottom portion of the service tool, via a valve of the service tool disposed in a first position;

transitioning the valve of the service tool from the first position to a second position; and blocking the fluid flow from flowing directly from the space between the service tool and the outer completion string to the internal flow path of the service tool via the valve positioned in the second position.

8. The method of claim 7, further comprising locking the valve in the second position.

9. The method of claim 8, wherein locking the valve in the second position comprises engaging a lock ring on a first sleeve of the service tool with a catch profile on a second sleeve of the service tool.

10. The method of claim 7, further comprising maintaining the valve in the first position prior to and while a setting tool coupled to the service tool sets a packer in a wellbore.

11. The method of claim 10, further comprising setting the packer via the setting tool while maintaining fluid communication between the workstring tubing and the wellbore below the packer.

12. The method of claim 7, further comprising closing the valve by applying a compression force to the service tool via the workstring tubing.

13. The method of claim 7, further comprising directing the fluid flow from the washpipe, through one or more screens disposed at a lower portion of the outer completion string, and into an annulus when the valve is in the first position.

14. A gravel pack system, comprising:

a service tool, wherein the service tool comprises:

a washpipe disposed at a first end of the service tool;

a crossover port disposed in a wall of the service tool that enables fluid to flow between workstring tubing coupled to a second end of the service tool opposite the first end and a space between the service tool and an outer completion string, wherein the outer completion string is disposed around the service tool; and a valve disposed in the wall of the service tool that in an open position directs fluid from the space between the service tool and the outer completion string directly into the service tool and toward the washpipe.

15. The gravel pack system of claim 14, further comprising:

the outer completion string;

a packer for isolating a portion of a wellbore formed in a subterranean formation, wherein at least a portion of the outer completion string is disposed at a position below the packer and at least partially surrounding the service tool;

one or more screens disposed at a lower end of the outer completion string; and a setting tool disposed within and removably coupled to the packer, wherein the setting tool is coupled to the service tool.

16. The gravel pack system of claim 15, wherein the outer completion string includes a gravel pack circulating sleeve comprising a circulating port through a wall of the gravel pack circulating sleeve that enables fluid to flow from the space between the service tool and the outer completion string to a position outside the outer completion string.

17. The gravel pack system of claim 14, wherein the service tool comprises a shearable connection that maintains the valve open and shears in response to compression of the service tool.

18. The gravel pack system of claim 14, wherein the service tool further comprises a locking mechanism for locking the valve in a closed position in response to compression of the service tool.

19. The gravel pack system of claim 14, wherein the service tool further comprises a first sleeve having the crossover port disposed therein and a second sleeve, wherein the first and second sleeves of the service tool are in a sliding engagement for closing or opening the valve, and wherein one of the first sleeve or the second sleeve comprises an extension that closes over the valve upon compression of the first sleeve and the second sleeve relative to each other.

20. The gravel pack system of claim 14, wherein the service tool further comprises a first sleeve having the crossover port disposed therein and a second sleeve, wherein the first and second sleeves of the service tool are in a sliding engagement for closing or opening the valve, and wherein the first sleeve comprises a first port formed therein and wherein the second sleeve comprises a second port formed therein.

* * * * *